US006529700B2

(12) United States Patent
Nukada et al.

(10) Patent No.: US 6,529,700 B2
(45) Date of Patent: Mar. 4, 2003

(54) SYSTEM FOR REMOVING LIQUID CARRIER

(75) Inventors: Hideki Nukada, Kanagawa-ken (JP); Yasushi Shinjo, Kanagawa-ken (JP); Yuko Nomura, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/893,670

(22) Filed: Jun. 29, 2001

(65) Prior Publication Data

US 2002/0025486 A1 Feb. 28, 2002

(30) Foreign Application Priority Data

Jun. 30, 2000 (JP) ..... 2000-199937

(51) Int. Cl.[7] ..... G03G 15/10
(52) U.S. Cl. ..... 399/249; 399/348; 399/355
(58) Field of Search ..... 399/238, 269, 399/250, 251, 343, 348, 355; 430/117, 118; 15/256.5, 256.52

(56) References Cited

U.S. PATENT DOCUMENTS 5,332,642 A 7/1994 Simms et al. ..... 430/125
5,752,144 A * 5/1998 Mammino et al. ..... 399/249
5,758,237 A * 5/1998 Abramsohn ..... 399/249
5,873,014 A * 2/1999 Knapp et al. ..... 399/249
5,978,630 A * 11/1999 Chang et al. ..... 399/249
6,006,059 A * 12/1999 Till et al. ..... 399/249

* cited by examiner

*Primary Examiner*—Hoan Tran
(74) *Attorney, Agent, or Firm*—Oblon, Spivak, McClelland, Maier & Neustadt, P.C.

(57) ABSTRACT

The present invention provides a liquid carrier removing system which efficiently removes liquid carrier from a liquid developed image on a latent image bearing member, and reduces disturbance of a visible image formed with toner particles.

The liquid carrier of the liquid developed image on the latent image bearing member is sucked by an absorbing cylinder, the surface of which is formed by a porous layer and pressed to the bearing member. A vacuum system is coupled to the absorbing cylinder to make the inside of the cylinder be negative pressure. The liquid carrier taken in the absorbing cylinder is sucked and collected inside the cylinder. In order that the pressed region of the absorbing cylinder may not be subjected to the sucking action by the negative pressure, a shield, which covers a part of the inside wall of the absorbing cylinder, is provided. Sucking and removing the liquid carrier of the liquid developed image and collection of the sucked liquid carrier are carried out separately.

15 Claims, 6 Drawing Sheets

SYSTEM FOR REMOVING LIQUID CARRIER

CROSS-REFERENCE TO RELATED APPLICATIONS

This application is based upon and claimed the benefit of priority from the prior Japanese Patent application NO. 2000-199937 filed on Jun. 30, 2000.

BACKGROUND OF THE INVENTION

The present invention relates to a liquid process type image-forming apparatus, and more particularly, concerns a system for removing liquid carrier from a liquid developed image obtained by developing with a developer containing liquid carrier and toner particles, and a liquid process type image-forming apparatus with the aforementioned system.

Image-forming apparatus such as an electrophotographic recorder or an electrostatic recorder utilizing a liquid developer has some advantages which cannot be realized with dry type one, so that its value has been thought better lately.

Being able to obtain high quality images thanks to extremely fine toner particles of sub-micron in diameter, being able to obtain inexpensively a good image quality comparable to that of printing (e.g. offset) because sufficient image density can be obtained with a small amount of toner, and being able to accomplish energy saving because toner can be fixed to a copy sheet at a relatively low temperature, etc. are the important advantages of the liquid process type image-forming apparatus employing liquid developer over the dry process type image-forming apparatus.

On the other hand, since conventional image-forming apparatus using liquid developer has some essential problems, the dry process technology has held an unchallenged position for a long time. One of these problems is related to liquid carrier for liquid developer.

Because non-polarity and non-conductivity are indispensable properties for the usual liquid carrier, petrochemical material is used, which volatilizes and emanates peculiar smell. In order to reduce such smell, several methods have ever been investigated to collect the smell in liquid state as much as possible before the liquid carrier volatilizes in the image-forming apparatus.

For example, U.S. Pat. Nos. 5,873,014 and 5,978,630 disclose a method to absorb and collect excess liquid carrier of a liquid developed image by contacting a cylindrical porous roller (inside of which is evacuated to be in sucking condition at its surface.) to a surface of an electrostatic latent image bearing member, on which the liquid developed image obtained by developing is formed.

On the other hand, it is required to remove and collect such liquid carrier without disturbing a visible image formed by toner particles on the surface of the latent image bearing member, or without exfoliating the toner particles from the latent image forming surface.

For example, in the method to remove and collect the liquid carrier mentioned above, disturbance of the visible image and exfoliation of the toner particles are prevented by preparing a part of the porous roller with conductive material and giving the porous roller a bias voltage to keep off the toner particles.

However, sucking up the excess liquid carrier of the liquid developed image by a negative pressure makes the sucking force difficult to control, and then proper range of sucking becomes narrow. Therefore when the sucking force by a vacuum pump is raised to collect quickly the liquid carrier absorbed in the porous material, not only the liquid carrier absorbed in the porous material but also the toner particles forming the visible image on the electrostatic latent image forming surface are exfoliated. The inventors have realized that the roller cannot bear operation for a long period by this method, because the exfoliated toner particles clog up the fine pores of the porous roller. U.S. Pat. No. 5,873,014 discloses an idea to blow off above-mentioned clogging using a positive pressure.

Furthermore, when multicolor images are formed by means of Image on image' method in which a second color visible image is formed in layers on a first color visible image after the first color visible image has been formed, the toner particles forming the second color image are selectively taken off because developing adhesive force of the particles differs from that of the first color particles if the aforementioned collection/removing method for the liquid carrier is adopted, and consequently the problem that a desirable color cannot be created takes place.

As mentioned above, in the conventional liquid process type image-forming apparatus, there have been some problems that the liquid developed image is disturbed when the excess liquid carrier is removed, and the roller cannot bear a long period operation.

BRIEF SUMMARY OF THE INVENTION

In accordance with an aspect of the present invention, an liquid carrier removing system for removing at least a part of liquid carrier from a liquid developed image formed with toner particles dispersed in the liquid carrier and adhered by electrophoresis to an electrostatic latent image on an image forming surface movable in a predetermined direction, the system comprising:

an absorbing cylinder being pressed by a portion of the image forming surface on which the liquid developed image is formed, and absorbing at least a part of the liquid carrier on the portion when the portion is released from the pressed condition as the image forming surface moves, wherein the absorbing cylinder has a porous core and an elastic porous layer formed on the porous core;

a vacuum system coupled to the absorbing cylinder, which collects the liquid carrier absorbed in the elastic porous layer into an inner side of the absorbing cylinder with generation of a negative pressure; and a shield arranged at the inner side of the absorbing cylinder and fixed at least a region corresponding to the pressed portion for preventing an air flow caused by the negative pressure from flowing into said cylinder.

Furthermore, in accordance with another aspect of the present invention, an image-forming apparatus comprises:

an electrostatic latent image bearing member having a cylindrical electrostatic latent image forming surface;

at least one of a plurality of stages, the stage including a charger located around said electrostatic latent image forming surface for charging said forming surface, an exposure apparatus which forms the electrostatic latent image on the charged forming surface, a developer unit which develops the electrostatic latent image with toner particles dispersed in liquid carrier into a liquid developed image, and a squeeze roller which exfoliates a part of the liquid carrier of the liquid developed image;

a liquid carrier removing apparatus containing:

an absorbing cylinder being elastically pressed by a portion of the forming surface on which the liquid developed image through the squeeze roller is formed and absorbing at least a part of the liquid carrier on said portion when the portion is released from the pressed condition as said forming surface moves, wherein said absorbing cylinder has a porous core and an elastic porous layer formed on the porous core, a vacuum system coupled to the absorbing cylinder, which collects at least a part of the liquid carrier absorbed in the elastic porous layer into an inner side of the absorbing cylinder with generation of a negative pressure; and a shield arranged at the inner side of the absorbing cylinder and fixed at least a region corresponding to the pressed portion for preventing an air flow caused by the negative pressure from flowing into the cylinder; and a transferring system which transfers the liquid developed image via the liquid carrier removing apparatus to a medium.

In accordance with the aspect of the present invention, thanks to the presence of the shield, the liquid carrier is removed only by a sucking force of the porous body, even though the inside of the porous cylinder is decompressed. As the liquid carrier absorbed in the porous body is sucked inside the cylinder by decompressing the inside of the porous cylinder, collecting capability for the liquid carrier recovers when the cylinder rotates in the porous body and then contacts the liquid carrier on the surface of the latent image bearing member.

A similar element is represented by the same mark through all Figures.

DETAILED DESCRIPTION OF THE INVENTION

Referring to FIG. 1 to FIG. 5, an embodiment of the present invention will be explained.

Figure 1:
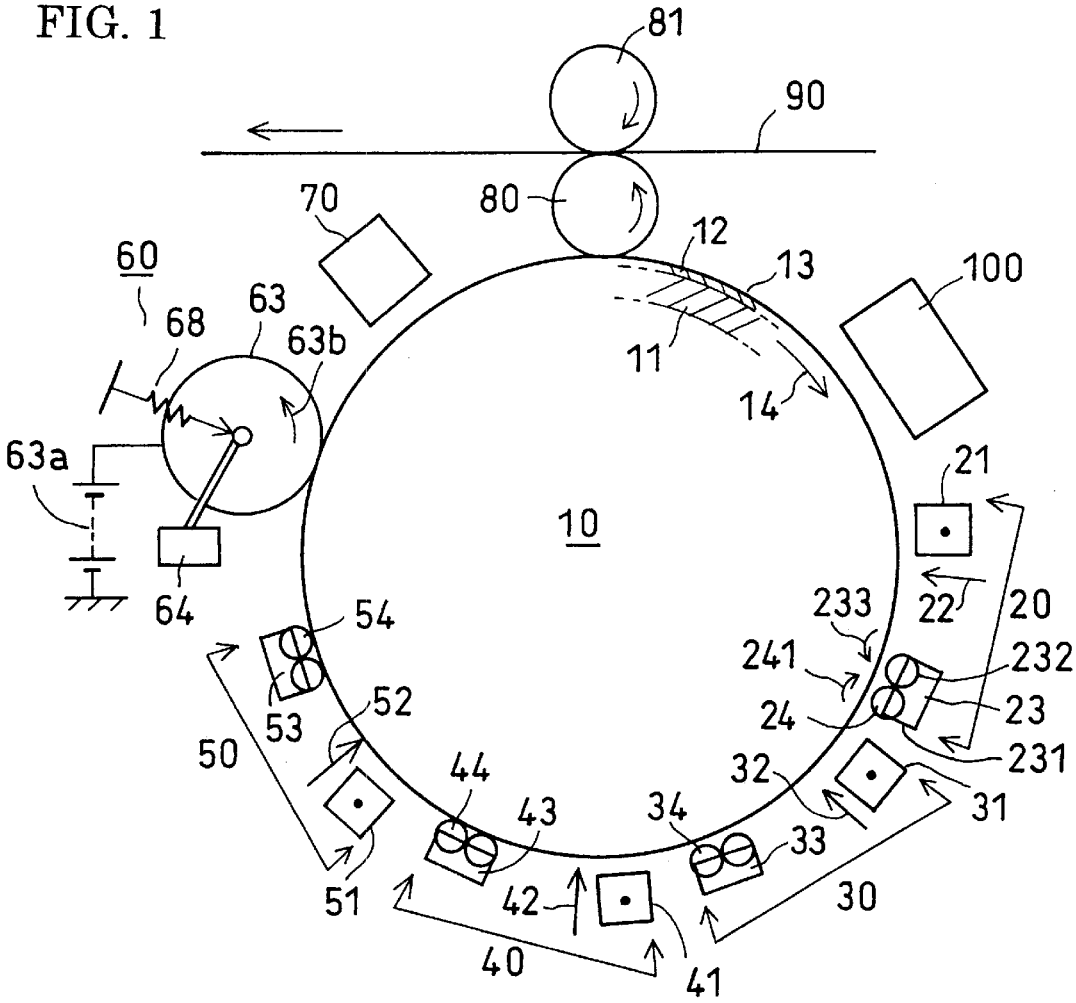
FIG. 1 is a schematic diagram of an embodiment of the liquid process type image-recording apparatus in accordance with the present invention.

In FIG. 1, a photosensitive drum, on the surface of which an organic or amorphous silicon photosensitive layer 12 is provided, for example, a conductive cylindrical solid substrate 11 such as aluminum, as an electrostatic latent image forming surface 13, is employed as an electrostatic latent image bearing member having a photosensitive layer on its surface. Furthermore, it is preferable to provide a release layer on the utmost surface of the photosensitive layer 12 in order to prevent toner particles from sticking to the latent image bearing member. Though a roller-like latent image bearing member 10 is used in FIG. 1, an endless elastic circular belt having a photosensitive layer on its surface may be utilized to make the latent image bearing member portable.

The latent image bearing member 10 rotates in a direction of arrow 14, and the latent image forming surface 13 passes successively through a plurality of image-forming stages 20, 30, 40 and 50 with toner particles having different colors from each other, which are all located around the bearing member 10. The image-forming stage 20 through which the latent image forming surface passes first comprises a charger 21, an exposure apparatus 22, a developer unit 23 and a squeeze roller 24. The latent image forming surface 13 is charged by the charger 21 comprising a corona discharger, and then exposed selectively by the laser scanning type exposure apparatus 22 to which an image signal is supplied, and consequently an electrostatic image containing the area which remains still charged and the residual area where charged quantity has decreased by exposure is formed on the latent image forming surface 13.

The electrostatic latent image is developed by the developer unit 23. The developer unit 23 comprises a container 231 storing the developer containing a liquid carrier and toner particles and a roller-shaped development electrode 232 which faces the latent image bearing member 10 in non-contact manner, and to which a development voltage is supplied. By rotating the roller-shaped development electrode in the direction of arrow 233, the liquid developer is transferred between the development electrode and the latent image bearing member 10, and then the toner particles are put by electrophoresis on the latent image surface for developing, and consequently a visible image is obtained. Namely a liquid developed image is formed.

Moreover, the squeeze roller 24 located at downstream side of the development electrode 232 can be supplied with a potential to attract the remaining particles on the non-imaged portion, and further be rotated in the opposite direction 241 to the moving direction 14 of the latent image forming surface to exfoliate the liquid carrier of the liquid developed image obtained by the development, in order to reduce the quantity of the liquid carrier. Regulating the quantity of the liquid carrier in advance is important to ensure the quality of image treatment at the next image-forming stage.

The liquid developer contains a non-polarized insulating liquid carrier of isoparaffin hydrocarbon, e.g. Isoper L (produced by Exxon Corporation), and toner particles of 0.1 to 2 micrometers in diameter dispersed in the liquid carrier, and forms the first color visible image by adhering the toner particles to the development electrode by supplying a developing voltage in compliance with the electrostatic latent image. The toner particles are prepared to be a specified color by mean of combining a pigment, a dye and a resin.

The developer units 33, 43 and 53 of the image-forming stages 30, 40 and 50 following the image-forming stage 20 have the same structure as the developer unit 23, but contain toner particles whose colors are different from each other. The chargers 31, 41 and 51 have fundamentally the same structure as the charger 21. The exposure apparatus 32, 42 and 52 have also fundamentally the same structure as the exposure apparatus 22. Furthermore, the squeeze rollers 24, 34, 44 and 54 have the same structure as each other. By the second image-forming stage 30, the second color liquid developed image is formed on the first color liquid developed image. In the same manner, by the third image-forming stage 40, the third color liquid developed image is formed on the second color liquid developed image. Then, by the fourth image-forming stage 50, the fourth color liquid developed image is formed on the third color liquid developed image by means of 'Image on image' method, thus a color image is obtained.

Therefore, there are toner particles and the liquid carrier on the surface of the latent image bearing member 10 on which visible liquid developed image is formed. Most of the liquid carrier is removed and collected by a removing apparatus 60 from the surface of the latent image bearing member.

Removing and collecting the liquid carrier on the latent image forming surface 13 of the latent image bearing member 10 reduce adhering of the liquid carrier to a copy sheet 90 explained later, and prevent the liquid carrier from flowing toward the outside of the image-forming apparatus. Moreover, removing the liquid carrier can improve the transfer efficiency for the visible image to an intermediate transfer medium 80 described later.

After the liquid carrier is removed, the liquid developed image on the surface of latent image bearing member 10 passes through a dryer 70. The dryer 70 is containing an infrared heater or a blower or a combination thereof, and volatilizes liquid carrier still remaining in the liquid developed image on the surface of the latent image bearing member. Thereafter, the image constituted substantially of toner particles only is transferred to the intermediate transfer medium 80 of a drum. Here, as the intermediate transfer medium 80 is pressed to the latent image bearing member 10, the toner particles on the surface of the latent image bearing member 10 is transferred to the intermediate transfer medium 80 by using the adhesive force of the toner particles. Transfer process using such adhesive force of the toner particles can improve the transfer efficiency remarkably, thanks to transferring in the condition where the liquid carrier hardly exists on the surface of the latent image bearing member.

The visible toner image transferred to the intermediate transfer medium 80 is finally transferred to a recording medium 90 such as a copy sheet which is transported while being pinched between the intermediate transfer medium 80 and a compressing device 81.

In FIG. 1, the transfer apparatus comprised of the intermediate transfer medium 80 and the compressing roller 81 has been used. However it is possible that the recording medium is directly pressed to the latent image bearing member 10 by means of the compressing roller 81 for direct transferring. Furthermore, electric field transferring using discharge such as corona charger can be utilized instead of the compressing roller 81.

After transferring, some toner particles which have not been transferred remain on the surface of the latent image bearing member 10. By removing the remaining toner particles by means of a cleaner 100, a series of image-forming process finishes. Next developing process is carried out on the condition where toner particles never exist on the surface of the latent image bearing member 10.

Next, referring to FIG. 2 to FIG. 5, the removing apparatus 60 will be explained in more detail.

The removing apparatus 60 has a cylindrical shield 62 made of airtight or non-permeable material as an inner cylinder, and an absorbing cylinder 63 is mounted coaxially outside the cylindrical shield 62 and is able to rotate around the shield.

The absorbing cylinder 63 of the embodiment includes a solid porous core 66 and an elastic porous layer 67 around the core, and has fine pores through which the liquid carrier can flow from the outside wall to the inside wall of the cylinder 63.

To the cylindrical shield 62, a vacuum apparatus 64 such as vacuum pump to generate a negatively pressurized air flow is connected. The inside of the cylindrical shield 62 is decompressed by operating the vacuum apparatus, and consequently absorbing force is given to a slit aperture 65 opening along the axis of the cylindrical shield 62. In other words, in the inside of the cylindrical shield 62 having the aperture 65, a U-shaped channel-like space integrated with the aperture acts as an absorbing room 62*a*. Absorbing force is given to the aperture 65 by decompressing the inside of the absorbing room 62*a*. 'Negative pressure' here means a pressure lower than the surrounding atmospheric pressure.

On the other hand, the absorbing cylinder 63 comprises a cylindrical porous core 66 with an inner diameter substantially equal to the outer diameter of the cylindrical shield 62, and an elastic porous layer 67 formed on the surface of the porous core 66. The elastic porous layer 67 is pressed to the latent image bearing member 10 in the direction of the arrow 68*a* compressed by a pressing apparatus 68.

The cylindrical shield 62 is coaxially fitted in the absorbing cylinder 63, and the absorbing cylinder 63 can rotate around the cylindrical shield 62 with the cylindrical shield 63 being fixed thereto.

Figure 4:
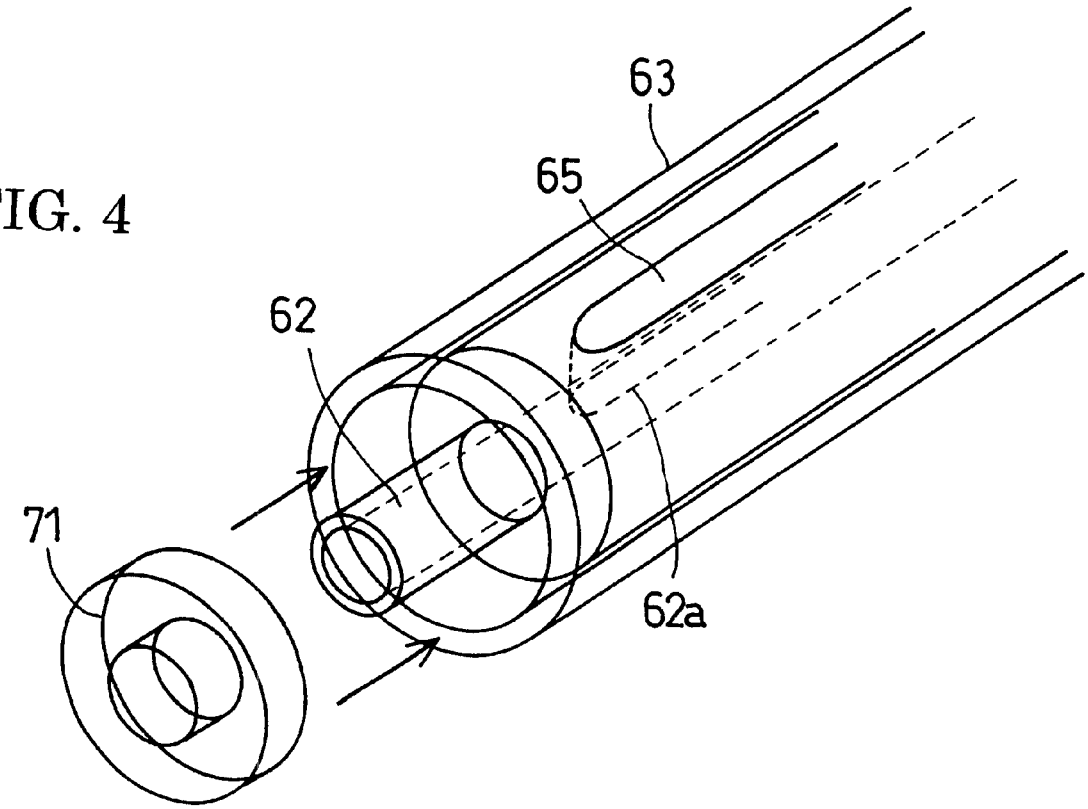
FIG. 4 is a partial perspective view of the absorbing cylinder shown in FIG. 2.

As shown in FIG. 4, a shaft bearing member 71 such as ball bearing is provided at each end of both cylinders (only one end is shown in the Figure), and a clearance 72 is formed between the outer periphery of the cylindrical shield 62 and the inner periphery of the absorbing cylinder 63, so as not to hinder the rotation. The reason why the clearance should be made as narrow as possible is raising the resistance against the air flowing in the clearance.

A vacuum apparatus 64 is coupled to one end of the cylindrical shield 62 to communicate with the absorbing room 62*a*. The other end is connected to the compressing spring 68, and the whole absorbing cylinder 61 is pressed against the face 13 of the latent image bearing member 10, keeping axially parallel to the latent image bearing member 10.

The absorbing cylinder 63 is containing the solid porous cylinder 66, whose outer periphery is covered with the elastic porous layer 67, and is permeable to air and liquid. Therefore the surface of the elastic porous layer 67 is contacted to the liquid carrier and compressed, and then released from compression to be swelled, and finally air gaps 120 in the layer expand and get action to suck the liquid. Moreover owing to the permeability to air and water, the liquid sucked and held by the air gaps draws out by decompressing and sucking the layer from its back face.

Figure 5:
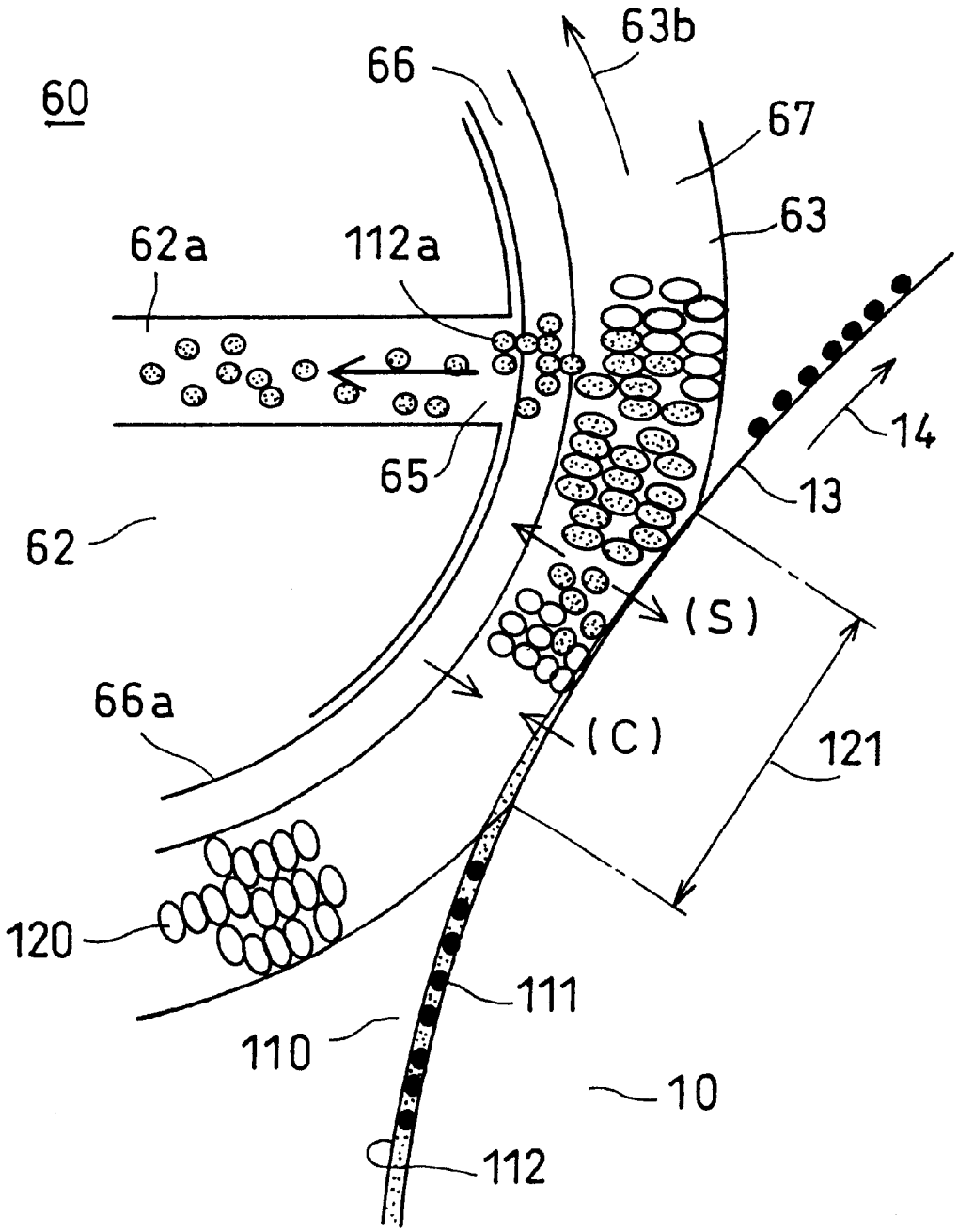
FIG. 5 is a schematic diagram showing the operation of an embodiment of the liquid carrier removing system in accordance with the present invention.

Referring to FIG. 5, the mechanism by which the absorbing cylinder 63 sucks and collects the liquid carrier contained in the liquid developed image formed on the latent image forming surface 13 of the latent image bearing member 10 will be explained. The latent image bearing member 10 holds, on its surface 13, a liquid developed image 110 formed via the final image-forming stage. This image contains toner particles 111 forming an image pattern and liquid carrier 112 remaining after being exfoliated by the squeeze roller at the stage.

As the bearing member 10 rotates in the direction of the arrow 14, the liquid developed image 110 arrives at the position of the absorbing cylinder 63 which rotates with the member together in the same direction as arrow 63*b*. Because the cylinder 63 presses the latent image forming surface 13, the fine air gaps 120 of the elastic porous layer 67 contact the liquid developed image 110, being compressed at the first portion of pressed region 121. Then they are released from the compression(C) and swell(S), with the rotation. The liquid carrier 112 of the image 110 contacted due to the swelling is sucked and taken in by the air gaps 120. In this case, capillary attraction is also additionally carried out. The absorbing cylinder 63 is connected to a bias voltage source 63*a* for supplying the cylinder a bias voltage with the same polarity as the particles, in order that the toner particles may not adhere to the absorbing cylinder.

Because the inner periphery 66*a* corresponding to the pressed region 121 of the absorbing cylinder 63 is covered with the wall of the cylindrical shield 62, the negative pressure absorbing force generated by the vacuum apparatus described later does not reach the pressed region of the absorbing cylinder.

The orifice 65 of the cylindrical shield 62 is located facing the outlet region 122 released from the pressed region of the absorbing cylinder 63. The liquid carrier 112*a* taken in by the elastic porous layer is sucked by negative pressure generated in the vicinity of the aperture 65 and stored in the sucking room 62*a* via the porous core 66, and then collected in a liquid carrier collector 69.

Namely, the liquid carrier removing apparatus 60 carries out separately sucking process A by compression and swelling of the elastic porous layer 67, and sucking-collecting process B by the aperture 65 of the cylindrical shield 62 and vacuum apparatus 64.

As described above, the cylindrical shield 62 covers the inner wall 66*a* of the absorbing cylinder corresponding to the pressed region 121 of the absorbing cylinder 63 and the latent image bearing member 10, from the negative pressure caused by the vacuum apparatus. Therefore, because the sucking force by the vacuum decompression means does not act the toner particles on the surface of the latent image bearing member 10, sucking the liquid carrier 112 from the liquid developed image 110 depends on compression and swelling of the elastic porous layer 67. Accordingly by regulating the compression force at the surface of the latent image bearing member 10, only the liquid carrier is stably and surely removed and collected without tearing off the toner particles.

It is preferable for a material constituting the absorbing cylinder 63 to use a material which is hard to be dissolved or deformed by the liquid carrier, though any material having fine pores to absorb the liquid carrier may be used without special limitation.

In other words, as the material for the elastic porous layer 67 of the absorbing cylinder, sponge-like foamed plastic may be used. Especially, deform caused by dissolution in the liquid carrier can be reduced by using plastics with low polarity such as fluoro-plastic, polyester, nylon, urethane, polyamide, or polyimide. For plastics with high polarity such as polyethylene, deformation due to the liquid carrier can be prevented by using ultra high polymer whose molecular weight is equal to or greater than 1,000,000. By using ultra high polymer, the layer can also have a function to be the porous supporter 14, because an elastic material with relatively high hardness can be employed.

It is desirable that the thickness of the elastic porous layer 67 should be equal to or greater than 0.2 mm, and equal to or smaller than 30 mm. If it is smaller than 0.2 mm, there will be a possibility that the liquid carrier in the surface of the latent image bearing member 10 cannot be removed sufficiently, because the absorbing capability of the elastic porous layer 13 for the carrier decreases. If it is greater than 30 mm, there will be a possibility that the liquid carrier in the elastic porous layer cannot be sucked even if the degree of decompression is raised, because the air resistance in the absorbing cylinder 63 increases.

As the material for aforementioned porous core 66, ultra high polymer mentioned above, porous sintered material of metal such as SUS stainless steel, porous ceramics such as aluminum oxide, or porous glass can be put to use. It is preferable that the average diameter of the fine pores is greater than the diameter of the molecule of the liquid carrier, for example equal to or greater than 0.02 micrometers.

The thickness of the porous core is preferable to be 1 mm or more and 40 mm or less. If it is smaller than 1 mm, its strength cannot be raised sufficiently. If it is greater than 40 mm, there will be a possibility that the liquid carrier in the elastic porous layer cannot be sucked even if the inside of the absorbing cylinder 12 is decompressed.

For the shield cylinder 62, airtight or non-permeable fine material preventing any gases from passing through may be used. It is preferable to select the material that is not dissolved or deformed by the liquid carrier. The same material as that for the absorbing cylinder explained above can be used as the ingredient.

As mentioned above, in accordance with the embodiment, when the liquid carrier is removed from the surface of colored visible image constituted of a pile of different colored toner particles on the surface of latent image bearing member, the toner particles of the upper layer do not be exfoliated selectively by using the removing apparatus mentioned above. Thus a desirable color tone can be obtained.

Figure 6:
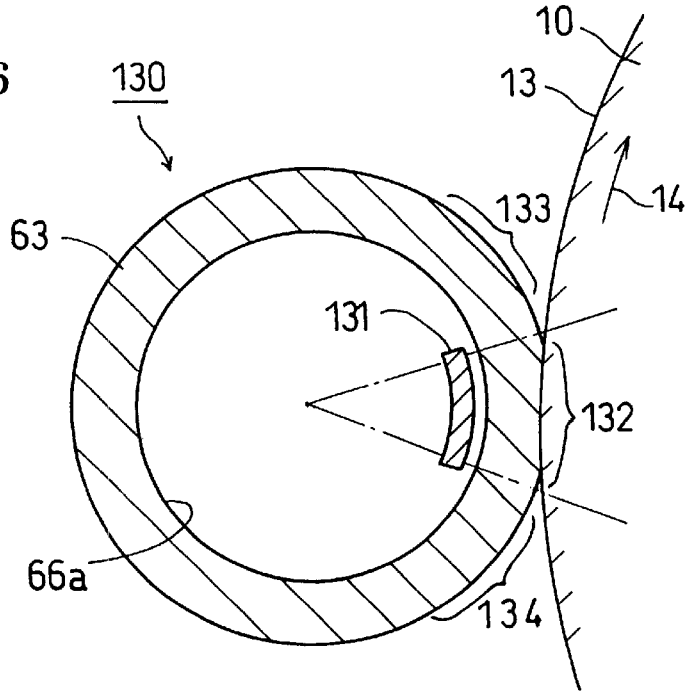
FIG. 6 is a schematic cross section of another embodiment of the present invention.

Another embodiment of the present invention is shown in FIG. 6. The carrier removing apparatus 130 is provided with a airtight or non-permeable shield 131 having a cross section of arc, along the axis of the absorbing cylinder, on the inner peripheral wall 66*a* of the air-permeable absorbing cylinder 63. The absorbing cylinder 63 has the outer peripheral surface containing an elastic porous layer, and is dented by the press to the surface 13 of the latent image bearing member 10. The capacity of the air gaps in the elastic porous layer caused by the dent is compressed or swelled. By the compression and the swelling, the liquid carrier of the liquid developed image on the latent image bearing member 10 is sucked into the air gaps.

The width of the arc of shield 131 is set to be equal to or slightly wider than a width covering the pressed region 132 of the absorbing cylinder, if one views the shield from the axis of the cylinder 63. The inside of the cylinder is coupled to a vacuum apparatus (not shown) to be kept in negative pressure. The shield 131 covers the pressed region 132 in order that the sucking force due to the negative pressure may not affect the region.

Air is sucked into the inside of the cylinder through the whole outer periphery except for the pressed region 132 of the cylinder, where the shield is positioned, due to the negative pressure inside the cylinder.

When the whole inside of the absorbing cylinder is decompressed, the sucking force acts on the whole region where the cylindrical shield is not positioned. As the shield is positioned only at the region facing the region where the liquid carrier on the surface of the latent image bearing member contacts thereto, the content by percentage of the liquid carrier at the region 133 becomes high just after the absorbing cylinder 63 has sucked the liquid carrier, whereas the region 134 rarely includes the liquid carrier, because the region is just before the position where the cylinder contacts the latent image bearing member 10 by rotation. In other words, at the region, which is just before the contact region, the absorbing cylinder 63 sucks outside air. In consequence, though sufficient liquid carrier may be collected, most of the sucking force by the decompression is used for sucking of air. Therefore, as the sucking force for the liquid carrier is lost, the vacuum system having enough capacity is desirable.

The shield 131 can be located anywhere, as long as it is at least adjacent to the inner wall surface 66*a* of the region where the absorbing cylinder 63 contacts the liquid carrier in the surface of the latent image bearing member 10. Therefore the shield is not necessarily required to be arc-shaped in the present invention.

As described above, by covering the pressed region from the negative pressure with the airtight shield, the liquid developer (toner particles and liquid carrier) on the surface of the latent image bearing member is not sucked by a sucking force created by decompressing the inside of the absorbing cylinder 63. Consequently, exfoliation of the toner particles forming the visible image in the liquid developed image can be decreased. In a region where the shield is not positioned, the liquid carrier absorbed in fine pores of the absorbing cylinder 63 by decompressing the inside of the absorbing cylinder 63 can be sucked in the absorbing cylinder 63, and then be collected in the liquid carrier collector.

Figure 7:
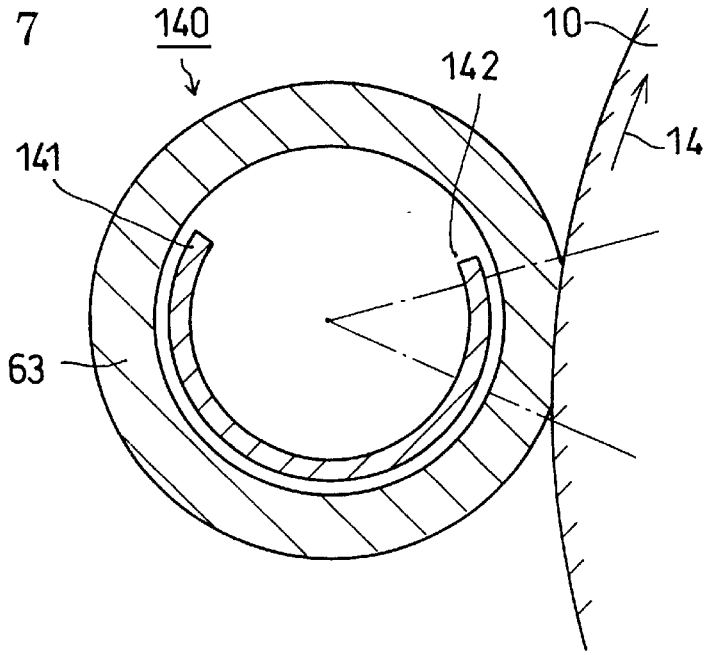
FIG. 7 is a schematic cross section of further embodiment of the present invention.

FIG. 7 shows further embodiment of the present invention. The carrier removing apparatus 140 is coaxially provided in the air-permeable absorbing cylinder 63, with the cylindrical shield 141 having an aperture 142 at its upside. The shield does not rotate. only the absorbing cylinder 63 can rotate, and it rotates together with the latent image bearing member 10, being pressed thereto.

The region except the aperture is blocked from the negative pressure by using the cylindrical shield having the aperture 142. Therefore, sucking the liquid carrier absorbed in the absorbing cylinder 63 via a limited region facing the aperture makes loss of the liquid be decreased.

Particularly the loss can be more reduced with the outer diameter of the cylindrical shield 141 being substantially the same as the inner diameter of the absorbing cylinder 63, provided that the outer diameter of the cylindrical shield 141 is made smaller than the inner diameter of the absorbing cylinder 63 in order that the absorbing cylinder 63 can rotate along the surface of the cylindrical shield 141. In this case, sucking effect is substantially the same, if the ratio of said outer diameter to said inner diameter is in the range between 90% and 100%.

Preferably the difference between the two diameters is 0.1 to 1 mm. Furthermore, by making the outer periphery of the cylindrical shield and the inner periphery of the absorbing cylinder smooth, the absorbing cylinder 63 can rotate more smoothly.

Moreover it is preferable that rotating speed of the surface of the absorbing cylinder 63 is equal to that of the surface of the latent image bearing member 10. If there is a difference of rotating speed between them, the absorbing cylinder would disturb the liquid developed image. The latent image bearing member 10 and the absorbing cylinder 63 can rotate at the same rotating speed by connecting them with individual drivers respectively. However, the absorbing cylinder 63 can follow the latent image bearing member 10, and rotate together therewith at the same speed, by making the friction between the outer surface of the absorbing cylinder 63 and the latent image bearing member 10 be greater than the friction between the inner surface of the absorbing cylinder 63 and the cylindrical shield 141.

The aperture 142 provided on the cylindrical shield 141 is formed upward (in vertical direction) in FIG. 7.

Because of the aperture 142 being upward, the liquid carrier on the surface of the aperture 142 in the absorbing cylinder 63 is applied with a force toward the inside of the cylindrical shield 63 caused by its own weight, so that the sucking force by the vacuum apparatus used for collecting the liquid carrier can be reduced. Since the liquid carrier sucked in the cylindrical shield can be stored, re-sucking of the liquid carrier in the absorbing cylinder 63 can be prevented. Furthermore, prevention of the re-sucking can prevent the liquid carrier remaining in the cylindrical shield from dispersing toward outside the absorbing cylinder, at a moment when the power source for the image-forming apparatus has been turned off.

Figure 2:
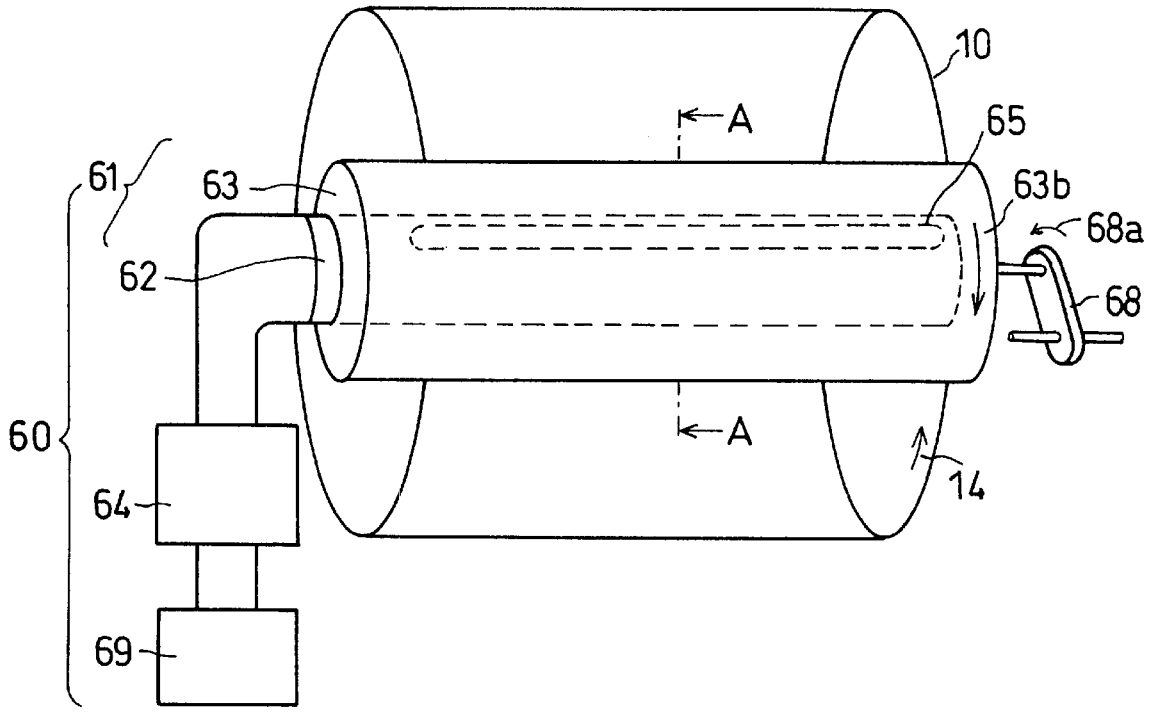
FIG. 2 is a perspective schematic diagram of an embodiment of the liquid carrier removing system in accordance with the present invention.
Figure 3:
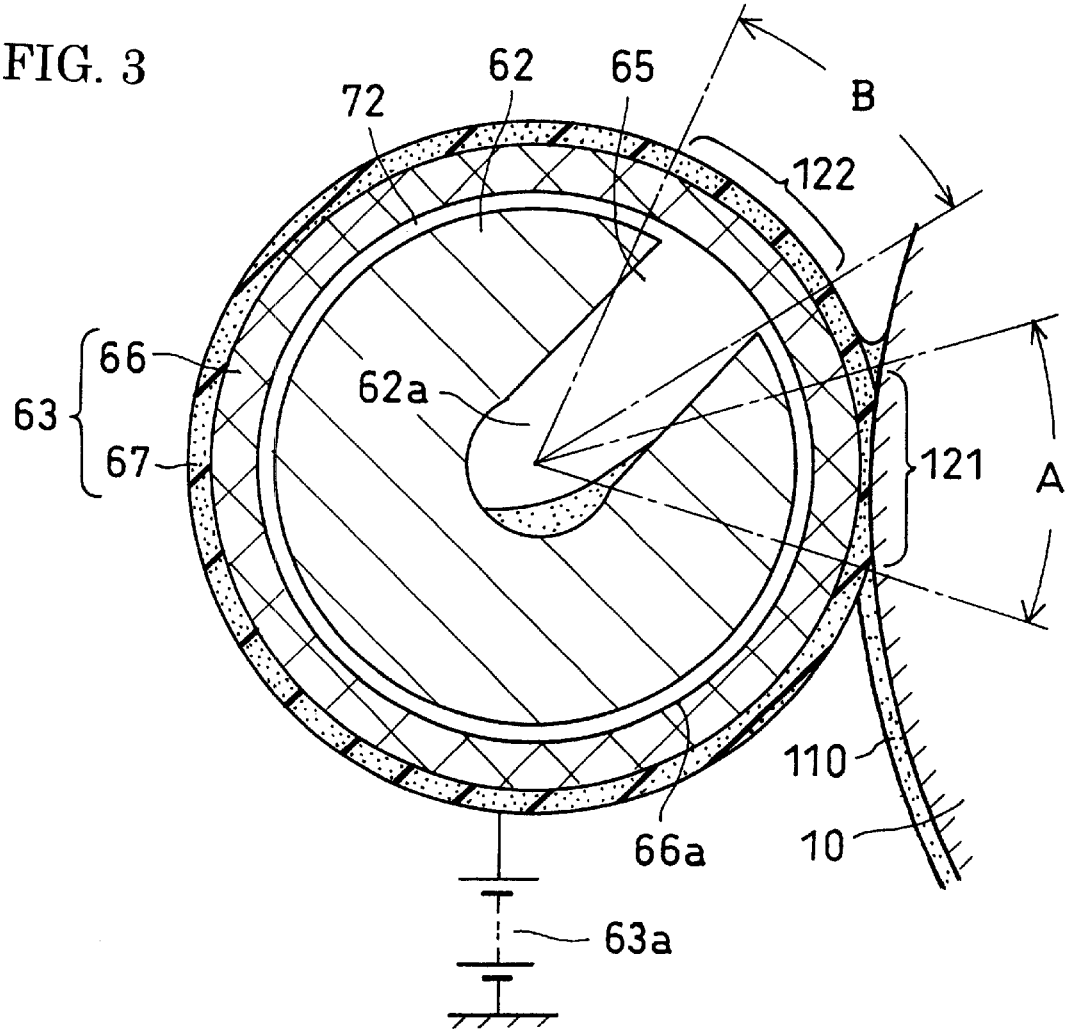
FIG. 3 is a cross section cut at A—A line of FIG. 2.

Further embodiment of the present invention is to apply the liquid carrier removing system shown in FIG. 2 to the whole or a part of squeeze rollers 24, 34, 44, 45 described by FIG. 1. The liquid developed image obtained via the development electrode is pressed to the absorbing cylinder constituting the roller, to suck and remove a part of the liquid carrier in the image, and then the liquid carrier is delivered to the charger of the next image-forming stage. The liquid carrier is adjustable by the compression and swelling of the absorbing cylinder.

As mentioned above, in accordance with the present invention, the liquid carrier can be efficiently collected without exfoliating the visible pattern of the toner particles from the liquid developed image with the liquid carrier on the latent image bearing member. Consequently the liquid developed image is not disturbed. Moreover, as the toner particles do not clog the fine pores of the absorbing cylinder, components for removing can be used for a long period.

While this invention is explained by using several embodiments, it is evident that the present invention can be applied to other variations or applications unless they deviate from the point of this invention.

What is claimed is:

1. An liquid carrier removing system for removing at least a part of liquid carrier from a liquid developed image formed with toner particles dispersed in said liquid carrier and adhered by electrophoresis to an electrostatic latent image on an image forming surface movable in a predetermined direction, said system comprising:

an absorbing cylinder being pressed by a portion of said image forming surface on which said liquid developed image is formed, and absorbing at least a part of said liquid carrier on said portion when said portion is released from the pressed condition as said image forming surface moves, wherein said absorbing cylinder has a porous core and an elastic porous layer formed on said porous core;

a vacuum system coupled to said absorbing cylinder, which collects said liquid carrier absorbed in said elastic porous layer into an inner side of said absorbing cylinder with generation of a negative pressure; and a shield arranged at the inner side of said absorbing cylinder and fixed at least a region corresponding to said pressed portion for preventing an air flow caused by the negative pressure from flowing into said cylinder.

2. The liquid carrier removing system as stated in claim 1, wherein said shield contains a cylinder having an aperture formed with airtight or non-permeable material, and is coupled to said vacuum system, wherein said aperture faces an inner peripheral wall of said absorbing cylinder.

3. The liquid carrier removing system as stated in claim 2, wherein the aperture of said shield faces upward.

4. The liquid carrier removing system as stated in claim 2, wherein said shield covers said inner peripheral wall of said absorbing cylinder from sucking of air by said vacuum system at the part facing an outer peripheral wall of the shield.

5. The liquid carrier removing system as stated in claim 1, wherein an inner peripheral wall of said absorbing cylinder is located adjacent to said shield.

6. The liquid carrier removing system as stated in claim 1, wherein said absorbing cylinder is rotatably held by said shield with a bearing member.

7. The liquid carrier removing system as stated in claim 1, wherein said absorbing cylinder rotates together with said latent image forming surface by means of the friction between them.

8. An image-forming apparatus comprising a bearing member with a forming surface of an electrostatic latent image movable in a predetermined direction, a developer unit forming a liquid developed image by developing said electrostatic latent image formed on said forming surface with toner particles dispersed in liquid carrier, and a liquid carrier removing system for removing at least a part of said liquid carrier from said liquid developed image: wherein said liquid carrier removing system comprises;

an absorbing cylinder being pressed by a portion of said image forming surface on which said liquid developed image is formed, and absorbing at least a part of said liquid carrier on said portion when said portion is released from the pressed condition as said image forming surface moves, wherein said absorbing cylinder has a porous core and an elastic porous layer formed on said porous core;

a vacuum system coupled to said absorbing cylinder, which collects said liquid carrier absorbed in said elastic porous layer into an inner side of said absorbing cylinder with generation of a negative pressure; and a shield arranged at the inner side of said absorbing cylinder and fixed at least a region corresponding to said pressed portion for preventing an air flow caused by said negative pressure from flowing into said cylinder.

9. An image-forming apparatus comprising:

an electrostatic latent image bearing member having a cylindrical electrostatic latent image forming surface;

at least one of a plurality of stages, said stage including a charger located around said electrostatic latent image forming surface for charging said image forming surface, an exposure apparatus which forms said electrostatic latent image on said charged image forming surface, a developer unit which develops said electrostatic latent image with toner particles dispersed in liquid carrier into a liquid developed image, and a squeeze roller which exfoliates a part of said liquid carrier of the liquid developed image;

a liquid carrier removing apparatus containing:

an absorbing cylinder being elastically pressed by a portion of said image forming surface on which said liquid developed image through said squeeze roller is formed and absorbing at least a part of said liquid carrier on said portion when said portion is released from the pressed condition as said image forming surface moves, wherein said absorbing cylinder has a porous core and an elastic porous layer formed on said porous core, a vacuum system coupled to said absorbing cylinder, which collects at least of a part of said liquid carrier absorbed in said elastic porous layer into an inner side of said absorbing cylinder with generation of a negative pressure; and a shield arranged at the inner side of said absorbing cylinder and fixed at least a region corresponding to said pressed portion for preventing an air flow caused by the negative pressure from flowing into said cylinder; and a transferring system which transfers said liquid developed image via said liquid carrier removing apparatus to a medium.

10. The image-forming apparatus as stated in claim 9, wherein said shield contains a cylinder having an aperture formed with airtight or non-permeable material, and is coupled to said vacuum system, wherein said aperture faces an inner peripheral wall of said absorbing cylinder.

11. The image-forming apparatus as stated in claim 9, wherein said squeeze roller is composed with a liquid carrier removing system including:

a second absorbing cylinder being pressed by a second portion of said image forming surface on which said liquid developed image is formed, and absorbing at least a second part of said liquid carrier on said first portion when said first portion is released from the pressed condition as said image forming surface moves, wherein said second absorbing cylinder has a second porous core and a second elastic porous layer formed on said second porous core;

a second vacuum system coupled to said second absorbing cylinder for collecting said liquid carrier absorbed in said second elastic porous layer into a second inner side of said second absorbing cylinder with generation of a second negative pressure; and a second shield arranged at the second inner side of said second absorbing cylinder and fixed at least a second region corresponding to said second pressed portion for preventing an air flow caused by said second negative pressure from flowing into said second cylinder.

12. The image-forming apparatus as stated in claim 9, wherein a bias voltage source is connected to a point between said electrostatic latent image forming surface and said absorbing cylinder.

13. The image-forming apparatus as stated in claim 9, wherein said transferring system transfers said liquid developed image to the medium and comprises an intermediate transferring medium.

14. The image-forming apparatus as stated in claim 13, wherein said intermediate transferring medium is pressed to said electrostatic latent image forming surface.

15. The image-forming apparatus as stated in claim 9, further including a liquid carrier dryer located between said liquid carrier removing apparatus and said transferring system.

* * * * *